US005798945A

United States Patent [19]

Benda

[11] Patent Number: 5,798,945

[45] Date of Patent: Aug. 25, 1998

[54] APPARATUS FOR BUILDING ENVIRONMENTAL REPORTING AND CONTROL

[75] Inventor: George Benda, Itasca, Ill.

[73] Assignee: Chelsea Group Ltd., Itasca, Ill.

[21] Appl. No.: 759,755

[22] Filed: Dec. 3, 1996

Related U.S. Application Data

[63] Continuation of Ser. No. 346,463, Nov. 29, 1994, abandoned, which is a continuation-in-part of Ser. No. 257,157, Jun. 9, 1994, Pat. No. 5,553,006.

[51] Int. Cl.[6] ..... G08B 17/10

[52] U.S. Cl. ..... 364/550; 364/556; 340/310.01; 73/31.01

[58] Field of Search ..... 364/505, 506, 364/550, 556, 557, 496; 73/23.2, 23.34, 31.01, 31.02, 31.03, 31.06; 340/628, 632, 310.01, 310.08, 501, 517, 505, 521, 522, 531, 540, 310.06; 165/200, 209; 236/51, 46 R

[56] References Cited

U.S. PATENT DOCUMENTS

| | | | |
|---|---|---|---|
| 3,872,355 | 3/1975 | Klein et al. | 340/310.08 X |
| 4,088,986 | 5/1978 | Boucher | 340/521 |
| 4,186,873 | 2/1980 | Geisler et al. | 340/310.01 X |
| 4,429,299 | 1/1984 | Kabat et al. | 340/310.06 |
| 4,526,028 | 7/1985 | Hubner | 73/23.2 |
| 4,542,640 | 9/1985 | Clifford | 73/31.06 |
| 5,224,648 | 7/1993 | Simon et al. | 236/51 |
| 5,348,078 | 9/1994 | Dushane et al. | 165/209 |
| 5,361,982 | 11/1994 | Liebl et al. | 236/46 R |
| 5,394,934 | 3/1995 | Rein et al. | 165/200 |

*Primary Examiner*—Melanie Kemper
*Attorney, Agent, or Firm*—Clifford Kraft

[57] ABSTRACT

Small modules directly situated at power outlets in buildings, that contain at least one sensor gather and report local environmental data such as temperature, humidity, carbon dioxide concentration, motion, particulate matter concentration, carbon monoxide, methane, or other parameters. The local modules report data back over existing building power wiring to a central unit. The central unit may store or reduce data for reporting over to a computer over a conventional RS-232 link. The data can be used to prove compliance with environmental and safety regulations and requirements or used to control HVAC equipment. Also, the data can be displayed or used with energy price tier systems.

18 Claims, 6 Drawing Sheets

APPARATUS FOR BUILDING ENVIRONMENTAL REPORTING AND CONTROL

This is a continuation of application Ser. No. 08/346,463 filed Nov. 29, 1994, now abandoned which was a continuation-in-part of application Ser. No. 08/257,157 filed Jun. 9, 1994, now issued as U.S. Pat. No. 5,553,006.

BACKGROUND

1. Field of the Invention

This invention relates generally to the field of building environmental safety, control, and regulatory compliance and more specifically to data sensing remote units reporting building environmental conditions to a central location for logging and control.

2. Description of the Related Art

Commercial buildings such as office complexes and residences are environmentally controlled by numerous thermostats that either activate local heating and cooling, or report to a central control location. These units, for the most part, do not measure, report, or record local environmental conditions other than temperature. Safety requirements and ever evolving governmental regulations may require recording and reporting of localized environmental conditions including temperature, humidity, carbon dioxide level, toxic gases such as carbon monoxide, and explosive gases such as methane or ethane, as well as particulate counts and other quantities. In a residence, it may be desirable to report different conditions from different parts of the house to a central unit that either controls heating and cooling, or records the house conditions for analysis. This may be especially true when energy price tiers are in effect.

Prior art systems exist for closed loop control of some building parameters such as temperature; remote sensors in these systems are mostly thermostats. These thermostats are mostly bimetal, analog electronic, pneumatic, or digital. None of these systems compile or report localized environmental data for compliance with governmental or safety regulations. In addition, none of these systems taylor the location of sensors to different conditions that may need to be sensed.

What is badly needed is small, local sensor modules able to communicate with a central control or logging system over building electrical wiring. Such sensor modules could contain different sensors to only measure what is necessary in certain locations in the building. For example, in a residence, it might be desirable to measure methane and carbon monoxide near a furnace, temperature, humidity, and carbon monoxide in bedrooms, and temperature, humidity, and carbon dioxide in kitchens or living rooms. The central logging and control system should be able to communicate with each of the local sensor modules to command data, and should be capable of communicating with a computer or telephone line to report data for compliance verification. The central logging system could store data until a local or remote computer requests it, or it could control HVAC equipment to set conditions as necessary. It could also contain alarms in case of methane or carbon monoxide detection. It must be able to take commands from a computer and modify its function on such commands.

SUMMARY OF THE INVENTION

The present invention comprises an apparatus that takes the physical form of a small box or module that plugs into 110 volt wall outlets. This box, or module, can contain one or more specialized sensors to sense a particular gas or condition. Such modules could measure temperature, humidity, carbon dioxide, carbon monoxide, particulate matter, biological contaminants, and other local parameters in a room. The modules communicate via an intelligent network over building power to a central data logger or control unit.

The local modules are capable of self-calibration, and contain local intelligence that can perform various data reduction, such as sensor linearization or long term averaging of parameters. They are powered from building power through the receptacle where they are located and are physically small enough to roughly occupy only the space in front of the power receptacle.

Local modules communicate data to a central location via an intelligent data network coupled by building power wires or dedicated wiring. In addition any module can communicate with any other module in such a network if necessary as well as with the central location.

A central data node or data logger communicates with all modules and commands the reporting of data parameters. This node contains a local microprocessor or computer and can perform more advanced data reduction than the remote modules. Such data reduction can be in the form of averages, differences in key parameters, statistical analysis, and other data processing. The reporting rate from different remote units can be different depending on building needs. In commercial buildings reporting rates can be stepped up during building emergencies or slowed for non-occupancy days such as weekends and holidays. In homes, the rates can change based on occupancy or priority.

The central logging unit also has the capability to communicate over a standard RS-232 serial data port to a personal computer (PC), modem, or larger computer to report data and take commands. Data can be formatted to comply with compliance reporting requirements and can be loaded out over this port for printing, storage, or further processing. In some systems, price tier data is available from a utility. The central system may be able to control HVAC equipment in the building to take advantage of energy pricing.

BRIEF DESCRIPTION OF THE DRAWINGS

For a more complete understanding of this invention, reference should now be made to the embodiments illustrated in greater detail in the accompanying drawings and described below by way of examples of the invention.

It should be understood, of course, that the invention is not necessarily limited to the particular embodiments illustrated herein.

DESCRIPTION OF PREFERRED EMBODIMENTS

Figure 1:
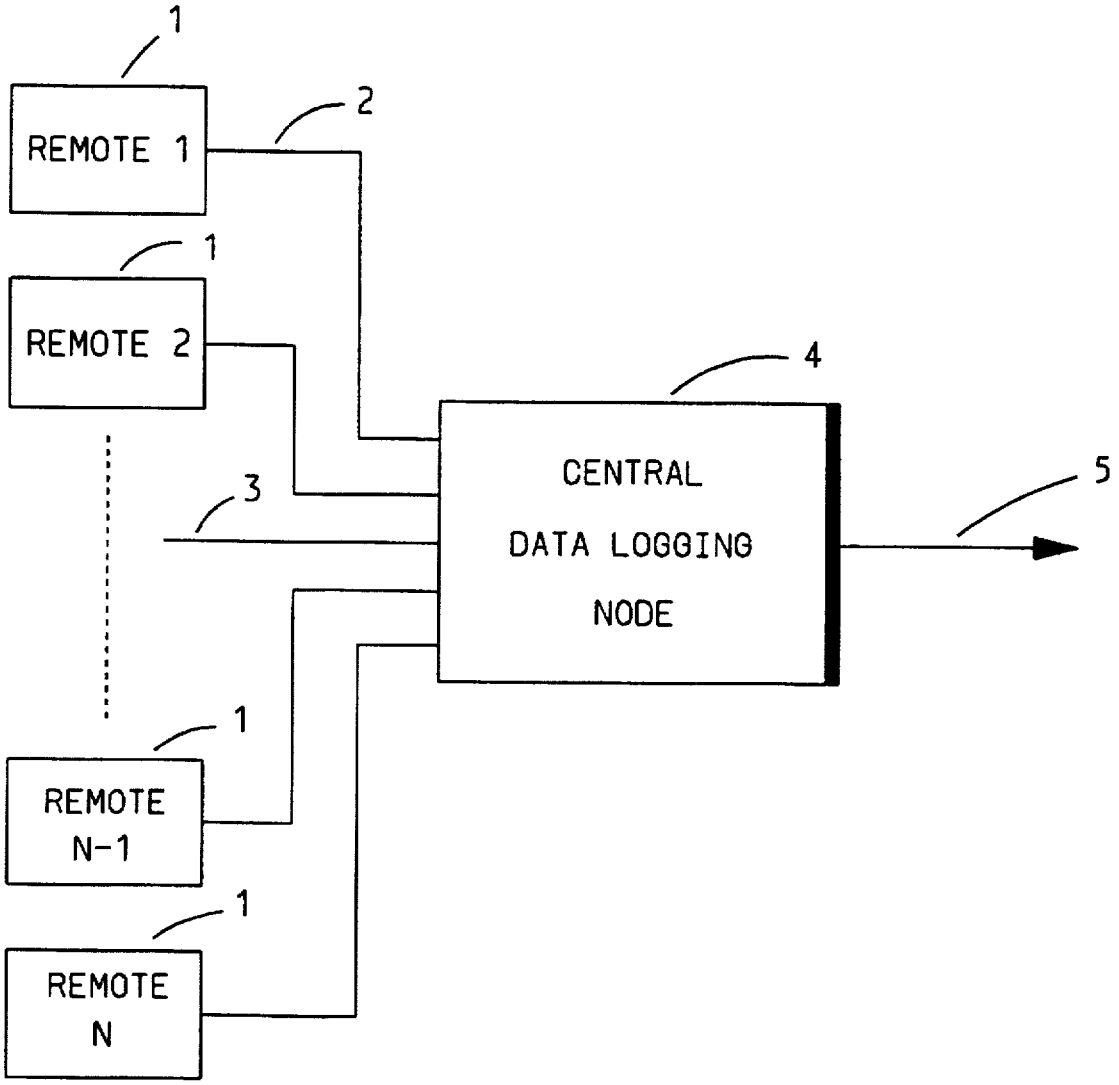
FIG. 1 is an overview of the invention showing remote sensor modules and the central data logging node.

FIG. 1 depicts an embodiment of the present invention. Remote units 1 numbered 1, . . . , N are located at various points throughout a building. Each remote 1 communicates over existing media 2 back to a central data logging node 4.

A remote unit 1 contains one or more sensors that sense ambient conditions in a given part of the building. Each remote unit 1 plugs directly into building power. Since it is desirable to detect different conditions from different remote units, there are several versions of the remote unit 1, each designed to sense different gases or conditions.

The remote units 1 of the present invention may communicate over building wiring 2 since they plug directly into wall sockets. If some remote unit 1 is to be located where communication is impossible over building power wiring, special twisted pair wiring 3 can be used for that remote unit.

The central data logging unit 4 communicates with many remotes 1 over the various communication paths 2,3, and polls each remote in turn for a report of ambient conditions in its vicinity. The frequency of this polling can be set by an operator; however, since the communications paths are not burdened, it can take place every several minutes. However, the present invention does not demand any particular frequency of data polling, except the minimum that would satisfy safety, comfort, or regulatory requirements. Thus polling can take place as infrequently as once a day or even once a week. Faster rates of once every several minutes yields sufficient data for establishing trends and averages. Also, different remotes can be polled at different rates if there are requirements to concentrate data gathering in certain parts of the building. As an alternative to polling, remote modules can asynchronously report changed conditions.

The central data logging node 4 also communicates with a personal computer (PC), other computer, or telephone line and modem over a standard RS-232 port 5. This port can also be used to download commands, change the polling rate, or change the type of data analysis being performed. The RS-232 port 5 can be used to upload raw or reduced data for print out of forms certifying compliance.

Figure 2:
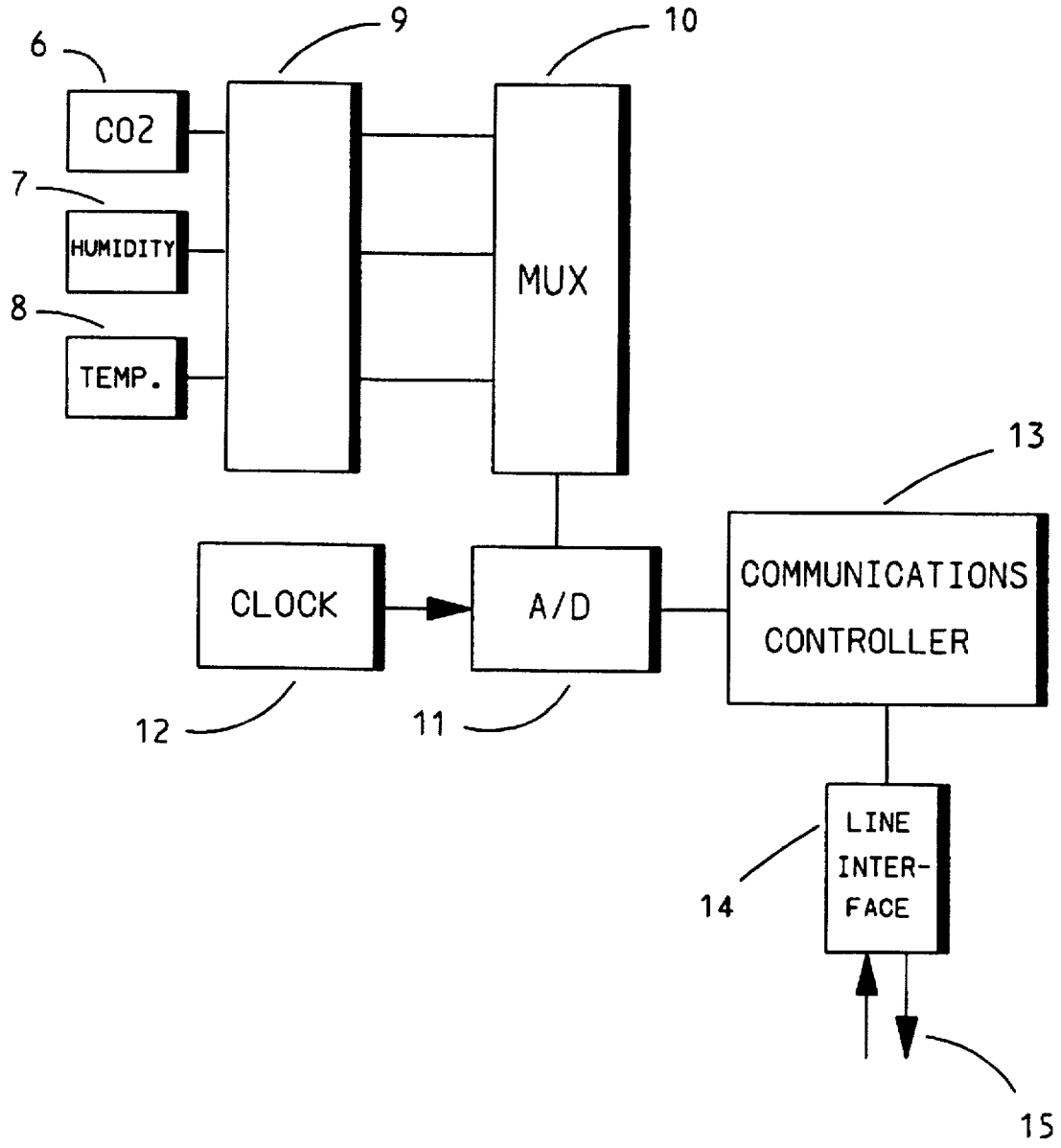
FIG. 2 is a block diagram of a typical remote sensor module.

FIG. 2 shows a typical remote data collection node 1. In this embodiment, three sensors are shown; however, the invention allows any number of ambient condition sensors to be used including sensors for temperature, humidity, carbon dioxide, toxic gases, explosive gases, particulate count, room population, and many other ambient conditions.

In the embodiment shown in FIG. 2, a carbon dioxide sensor 6 of the type that reports concentrations of between 50–2000 parts per million (PPM) of carbon dioxide in the air is used. This sensor can be a chemical type, an infrared absorption type, or other type of CO2 sensor. A typical sensor might be the 4000/4013 probe made by Solomat of Norwalk, Conn., or the model 1050 non-dispersive infrared sensor made by Telaire of Goleta, Calif. Relative humidity (RH) is sensed using a probe 7 similar to the model GIE CAP sensor made by General Eastern Co. reading from 0 to 100% RH, or the IH-3605 probe made by Hy Cal of El Monte, Calif. Temperature is measured 8 from below 32 degrees Fahrenheit to over 130 degrees Fahrenheit by an electronic means such as a temperature sensitive amplifier similar to the LM34A made by National Semiconductor or a current source such as LM134 also made by National Semiconductor. Thermistors such as those made by omega and others may also be used. Carbon monoxide, methane, and other gases can be sensed on heated catalyst sensors such as the W-Series sensors manufactured by Capteur of the U.K. or other gas sensors.

Figure 4:
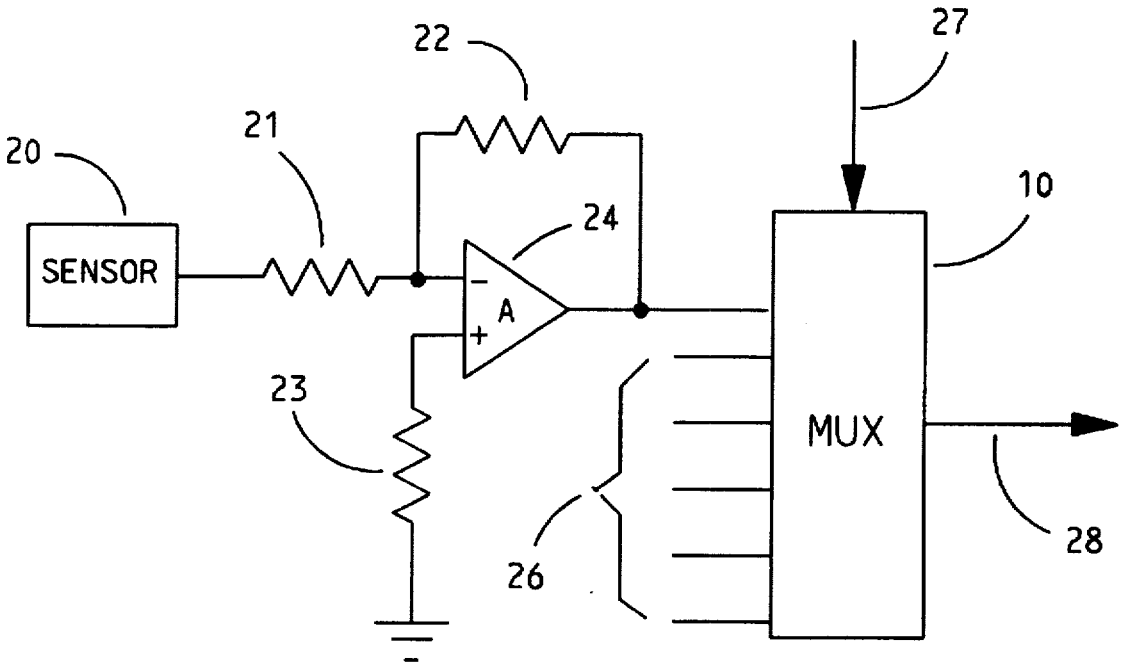
FIG. 4 is a schematic diagram of a typical sensor electronics interface.

Each sensor probe 6,7,8 must interface into an electronic signal conditioning circuit 9 to provide the correct signal level to be converted to digital. A typical sensor interface circuit is shown in FIG. 4. Here any of the sensors 20 provides a voltage (or current) to an amplifier 24. The amplifier 24 may be of the inverting (or non-inverting) type where its voltage gain is determined by the ratio of the feedback resistor 22 to the input resistor 21. A bias resistor 23 is provided to minimize offset voltage.

Returning to FIG. 2, the outputs of the interface circuits 9 enter an analog multiplexer 10 well known in the art and then into an analog to digital converter (A/D) 11. The multiplexer 10 and A/D 11 may be separate units, or may be combined in a single silicon chip similar to the model MAX192 made by Maxim Integrated Products. FIG. 4 shows a multiplexer 10 that has several (at least 8) signals 26 entering, and one analog signal 28 exiting to the A/D 11 (FIG. 2). The multiplexer is driven, or selected, by a signal 27 that originates from a local controller (not shown), or from the communications module 13 (FIG. 2).

Returning to FIG. 2, it can be seen that the A/D converter 11 is driven by a clock 12 that controls the convert rate. Since data is sampled at a relatively low rate, the clock need not run at high speed. A speed of several kilohertz can be chosen for convenience; however, many different conversion speeds may be used in the present invention. The A/D converter should provide at least 8 bits, and preferably 10 bits, resolution of the sampled data. The A/D resolution need not be more than the measuring resolution of the most accurate sensor. Accuracy can be increased by integration (averaging) techniques well known in the art of statistics. The exact resolution needed is determined by the choice of sensors used. Since the present invention allows a wide choice of sensor types, this must be determined after the particular choice of sensor probes is made. However, ten to twelve bit resolution is normally adequate for almost every application of the invention.

The A/D converter 11 supplies data in either parallel or serial form to the communications controller 13. The communications controller 13 can be any form of communications interface, including analog, serial, or parallel digital. A particularly useful communications interface comes from the family of communications devices made by Echelon Corp. of Palo Alto, Calif. A representative device is the MC143120 manufactured by Motorola Corp. under license from Echelon. Such devices provide a complete communications network throughout a building.

The communications interface 13 couples to a line interface 14 and onto building wiring 15. The present invention comprises different line interfaces based on the type of wiring encountered. In the case of AC building power wiring, the 110 V., 60 Hz must be blocked and high frequency signals placed on the line. This can be accomplished using spread spectrum techniques with a PLT-10 or similar unit manufactured by Echelon Corp. or with any other power line carrier technique. The signalling can be differential or common mode; for building power, the signalling is usually common mode well known in the art (the communications signal is placed between black/white on one side and green on the other). If special signal pair cable is used, the signalling should be differential mode.

Building 110 V. is converted to DC for use in the remote sensor modules. In addition, it may be desirable for remote units to have battery backup in order to continue to function during power outages and building emergencies, although this is not usually necessary for residential use. Remote units can quickly report ambient conditions in any room in a building, either asynchronously, or upon request from the central data logging unit 4. Thus, in commercial buildings, these units can become extremely important during building emergencies such as fires, etc.

Figure 3:
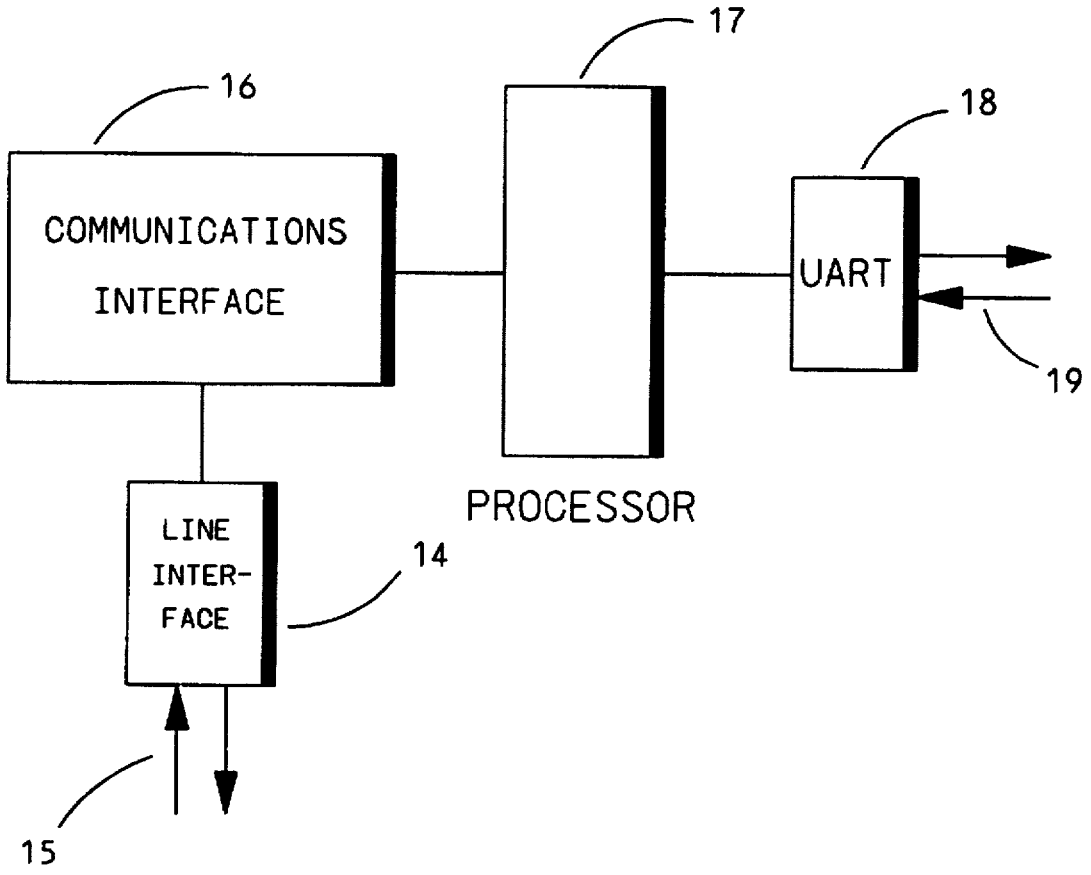
FIG. 3 is a block diagram of a central data logging node.

FIG. 3 shows a data logging node 4 (FIG. 1) in detail. The data logging node contains several physical line interfaces 14 (only one shown) with various physical lines 15 entering the unit. The line interface 14 is identical to those used in the remote units 1 with various type of building wiring. The line interfaces 14 are coupled into a communications interface 16 that is of the same type as those used in the remote units 1. However, this is the master communications interface 16 and is responsible for logically maintaining the communications network. This device 16 can poll the various remote units 1 on schedule and receive their data as to ambient conditions. These data are collected and stored in the communications interface 16 and passed to a processor means 17 when requested, or the communications interface 16 can interrupt the processor means 17 when data is available.

The processor means 17 can be a simple controller such as the 80C88 made by Harris and others, or it can be any microprocessor, or microcontroller, including the 68HC11 or 6805 series manufactured by Motorola, the 80186 manufactured by Intel, or any other microprocessor. The choice of processor means 17 is governed by the tasks it will be required to perform and the compatibility desired with other existing systems, as well as the cost and amount of memory needed. The processor means can also reside in a communications controller such as the MC143120 manufactured by Motorola under license from Echelon Corp.

The processor 17 receives building environmental data from numerous remote locations throughout a building. It stores this data in raw form and reduces it to averages and trends. In addition, it can form part of a closed loop controller that drives equipment intended to modify the measured data parameters such as carbon dioxide, temperature, humidity, etc. The processor means 17 is capable of performing any mathematics or data manipulation necessary to provide data in a usable form and prove compliance with safety and regulatory requirements.

The processor 17 communicates with a personal computer or remote computer with a standard serial transmitter/receiver (UART) 18 and RS-232 port 19 as is well known in the art. The data logging node 4 may have to store data for weeks before uploading it, so sufficient memory must be provided. This can be in the form of electronic memory or disk storage.

Figure 5:
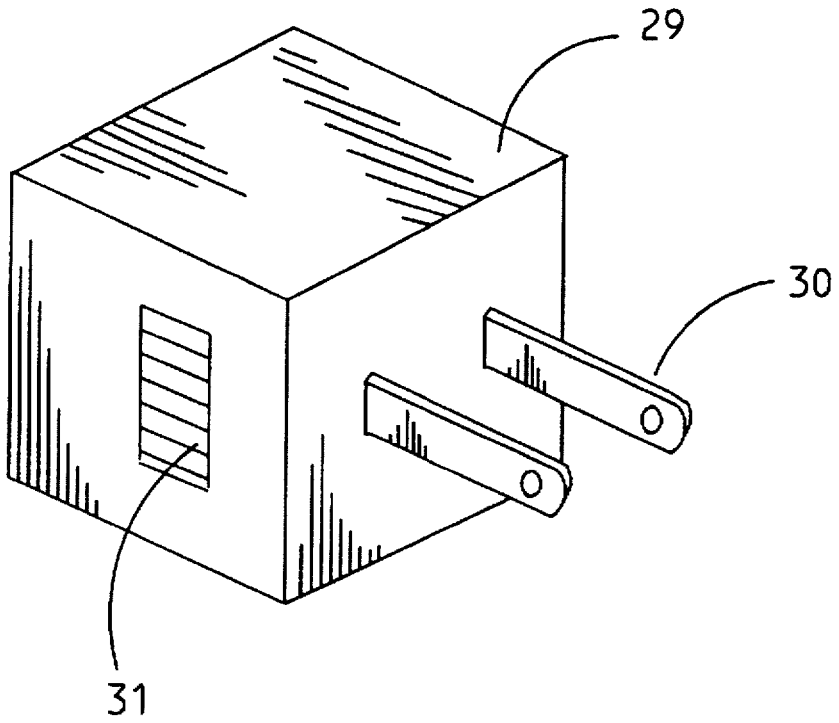
FIG. 5 is a sketch of a local module containing one or more sensors that operates directly out of building power outlets.

FIG. 5 shows a wall mounted remote unit. The module is contained in a plastic or metal outer container 29 or box. Metal fingers 30 extend into a standard residential or commercial wall power receptacle. Fingers 30 not only provide power to the unit, but act as conductors to transfer communications signals to and from building power. The module contains one or more sensors. These can be chosen in different embodiments of the present invention to sense gases such as methane, ethane, carbon monoxide or other gases. The unit can also contain temperature and humidity sensors.

Figure 6:
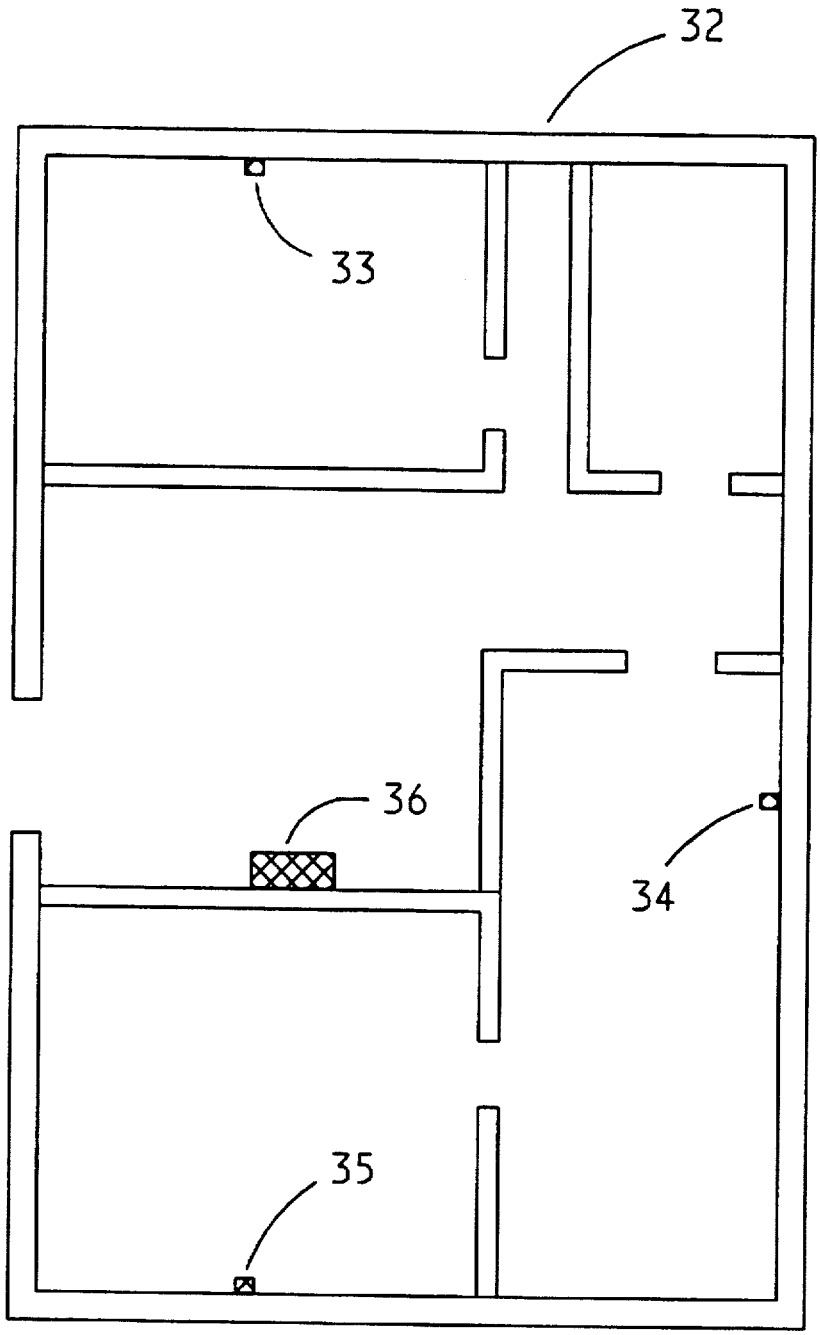
FIG. 6 shows a possible placement of local modules in a small residence.

FIG. 6 depicts the floor plan 32 of a simple residential building. At some central point in the house, a central or logger unit 36 is stationed which communicates over building power wiring with one or more remote modules located throughout the house. For example there might be a carbon monoxide sensor remote module 33 located in a bedroom, a temperature-humidity-carbon dioxide sensor remote module 35 located in a dining room, and a temperature-humidity sensor remote module 34 located in a kitchen. All of these remote modules, in addition to containing alarms for reporting dangerous conditions, communicate with the central unit 36 for logging and possibly energy control. This central unit 36 can be configured to directly control HVAC equipment, or it can simply log and analyze data. It could be in communications with a utility company that provides energy price tier information. In that case, it could make decisions about HVAC control in response to prices as well as conditions reported by the remote units.

It is to be understood that the above-described arrangements are merely illustrative of the application of the principles of the invention, and that other arrangements may be devised by those skilled in the art without departing from the spirit and scope of the invention.

I claim:

1. An apparatus for building gas concentration reporting comprising, in combination:

a gas sensor that reports a concentration value of a target gas;

an electrical circuit connected to said gas sensor, said circuit determining the concentration value from said gas sensor;

a powerline carrier transmitter connected to said electrical circuit;

an enclosure containing said gas sensor and said electrical circuit with a pair of protruding metal prongs, said prongs of the type that insert into standard building power receptacles, whereby, with said prongs inserted into a building power receptacle, electrical signals from said powerline carrier transmitter pass into said building power system reporting said concentration value.

2. The building gas concentration reporting apparatus claimed in claim 1 wherein said gas sensor is a carbon monoxide sensor.

3. The building gas concentration reporting apparatus claimed in claim 1 wherein said gas sensor is a carbon dioxide sensor.

4. The building gas concentration reporting apparatus claimed in claim 1 wherein said gas sensor is a methane sensor.

5. The building gas concentration reporting apparatus claimed in claim 1 wherein said gas sensor is a hydrogen sulphide sensor.

6. The building gas concentration reporting apparatus claimed in claim 1 wherein said gas sensor is an ammonia sensor.

7. For a residential or commercial building having a standard power distribution system with power outlets in various locations throughout the building, and an atmosphere inside the building possibly contaminated with toxic gases, hydrocarbon vapors, or other undesirable or poisonous material, a miniature, portable building environmental remote sensor unit comprising an enclosure equipped with a standard pair of electrical prongs whereby the unit can be plugged into any standard electrical outlet, at least one environmental gas detection sensor, an electronic circuit that determines a gas concentration value from that sensor, and a powerline communications system whereby the gas concentration value from the gas detection sensor is communicated over the building power distribution system.

8. The building environmental remote sensor claimed in claim 7 wherein the environmental gas sensor is a carbon monoxide sensor.

9. The building environmental remote sensor claimed in claim 7 wherein the environmental gas sensor is a carbon dioxide sensor.

10. The building environmental remote sensor claimed in claim 7 wherein the environmental gas sensor is a methane sensor.

11. The building environmental remote sensor claimed in claim 7 further comprising a humidity sensor whereby an environmental humidity value is also communicated over the building power distribution system.

12. The building environmental remote sensor claimed in claim 7 further comprising a temperature sensor whereby an environmental temperature value is also communicated over the building power distribution system.

13. In a building with a standard power distribution system, an apparatus for building environmental reporting comprising, in combination:

at least one environmental gas sensor that reports a concentration value of a target gas;

an electronic circuit connected to said gas sensor, said circuit determining the concentration value from said gas sensor and providing a means for powerline communication, whereby electrical signals are communicated on said building power system, said electrical signals representing the concentration value determined from said gas sensor;

an enclosure containing said gas sensor and said electronic circuit with a pair of protruding metal prongs, said prongs of the type that insert into a standard building power receptacle, whereby, with said prongs inserted into a building power receptacle, the building power system can power said electronic circuit, and the electrical signals from said powerline communications means can pass into and out of said building power system.

14. The building environmental reporting apparatus claimed in claim 13 wherein said gas sensor is a carbon monoxide sensor.

15. The building environmental reporting apparatus claimed in claim 13 wherein said gas sensor is a carbon dioxide sensor.

16. The building environmental reporting apparatus claimed in claim 13 wherein said gas sensor is a methane sensor.

17. The building environmental reporting apparatus claimed in claim 13 wherein said gas sensor is a hydrogen sulphide sensor.

18. The building environmental reporting apparatus claimed in claim 13 wherein said gas sensor is an ammonia sensor.

* * * * *